313-414 SR
11/8/77 XR 4,057,747

United States Patent [19]

Hamano

[11] 4,057,747

[45] Nov. 8, 1977

[54] IN-LINE PLURAL BEAM COLOR CATHODE RAY TUBE HAVING DEFLECTION DEFOCUS CORRECTING ELEMENTS

[75] Inventor: Eizaburo Hamano, Fukaya, Japan

[73] Assignee: Tokyo Shibaura Electric Company, Ltd., Japan

[21] Appl. No.: 622,447

[22] Filed: Oct. 14, 1975

[30] Foreign Application Priority Data

Oct. 14, 1974 Japan ..... 49-117185

[51] Int. Cl.[2] ..... H01J 29/50

[52] U.S. Cl. ..... 313/413; 313/414

[58] Field of Search ..... 313/412, 413, 428, 437, 313/442, 414; 335/211

[56] References Cited

U.S. PATENT DOCUMENTS

| | | | |
|---|---|---|---|
| 3,771,002 | 11/1973 | Standaart | 313/411 X |
| 3,866,080 | 2/1975 | Barkow | 313/412 |
| 3,899,761 | 8/1975 | Yamauchi | 313/428 X |

FOREIGN PATENT DOCUMENTS

| | | | |
|---|---|---|---|
| 1,397,804 | 6/1975 | United Kingdom | 313/412 X |

*Primary Examiner*—Lawrence J. Dahl
*Attorney, Agent, or Firm*—Oblon, Fisher, Spivak, McClelland & Maier

[57] ABSTRACT

In a color cathode ray tube including an electron gun means for projecting three electron beams in an in-line arrangement, there is provided deflection defocus correcting means which are disposed adjacent the side electron beams for neutralizing the deflection defocus of the side beam caused by the non-uniformity of the deflection fields.

13 Claims, 16 Drawing Figures

IN-LINE PLURAL BEAM COLOR CATHODE RAY TUBE HAVING DEFLECTION DEFOCUS CORRECTING ELEMENTS

BACKGROUND OF THE INVENTION

1. FIELD OF THE INVENTION

This invention relates to an in-line type color cathode ray tube wherein the deflection defocus of electron beans on the scanned screen caused by the non-uniformity of the deflecting fields are substantially corrected by using beam distortion correcting means.

2. DESCRIPTION OF THE PRIOR ART

An in-line type color cathode ray tube is provided with a shadow mask which is adjacent and opposite to a screen containing a plurality of different color phosphor elements formed on the face plate. An electron gun assembly is disposed in the neck portion of the tube for emitting three electon beams which lie in the same plane so as to pass through the mask aperture and impinge on the phosphor screen. These three electron beams in in-line arrangement are usually constructed so that the center beam passes along the tube axis and so that the pair of side beams are axially distant at equal distances from the tube axis. These three electron beams are converged and deflected by a convergence apparatus and a deflection yoke disposed about the outside of the cathode ray tube.

As compared with a conventional Δ (delta)—gun type color cathode ray tube in which the three electron beams are emitted from the apices of an equilateral triangle, this kind of in-line gun type color cathode ray tube has advantages, for example, in that the convergence adjustment of the electron beams is rather simple with the result that the covergence apparatus and its circuit can be simplified. This is significant for a color cathode ray tube in which a phosphor screen is comprised of a plurality of different color phosphor stripes.

However, this in-line type color cathode ray tube has the disadvantage that deflection defocus readily occurs in the electron beams because of the special non-uniform magnetic field of the deflection yoke which is necessary in order to obtain the required properties of the rasters. Accordingly, the picture quality of this tube deteriorates readily, especially in the peripheral portions of the screen.

A major cause of the deflection defocus of the in-line type color picture tube can be explained as follows. It is known that the deflection defocus of the electron beams is usually proportional to the $n$th power of the axial separation distance $Sg$ of the electron beams ($n \geqq 1.3$). As the axial separation distance $Sg$ of the side beams in in-line arrangement is greater by $\sqrt{3}$ times as compared with the three electron beams in delta arrangement, the deflection defocus of the side beam readily occurs. Furthermore, the nonuniformity of the deflection fields and the convergence fields plays a significant part in this deflection defocus.

FIG. 1 is a diagram illustrating the side beam distortion caused by the non-uniformity of the deflecting field. Because of the pin-cushion type horizontal deflection fields 4, the electron beam 1 is subjected to forces which are not uniform at each point. As the beam is deflected toward the peripheral portion of the screen, its shape is deformed approximately into an ellipse 2 of which the longitudinal axis is in the horizontal direction. Moreover, as regards the side beam 1 shown in the drawing, the extend of its deflection defocus is not symmetrical on the right and on the left of the screen. The curve 6 shows a magnetic flux density illustrating the non-uniformity of the pin-cushion shaped horizontal deflection field.

This deflection defocus appears to be also caused by the non-uniformity of the convergence field. In particular, the side beams passing through the dynamic convergence magnetic fields are influenced to a great extent. Accordingly, the deflection defocus due to the aforesaid deflection fields in further increased, and the shape of the side beams become longer and thinner at the peripheral portions of the screen as shown in FIG. 2. In most color picture tubes, the screen ratio is approximately 4 : 3, and therefore, the abovementioned deflection defocus of the side beams appears to a great extent in the horizontal direction and in the diagonal direction.

As described above, a color picture tube in which the electron beams are arranged in-line readily produces the deflection defocus caused by the deflection field and by the convergence field. Accordingly, if the electron beams are deflected in a horizontal plane, the beam spots 2 become elongated in the horizontal direction as shown in FIG. 2. Consequently, the picture resolution of this in-line type color picture tube is greatly impaired at the peripheral portion of the screen. Furthermore, as the beam spot diameter in the vertical direction becomes smaller, a moire pattern readily appears in this tube.

Another important fact is that the beam spot size differs from point to point. This disadvantage is especially apparent at high beam current. Although proper convergence appears at low beam current, misconvergence appears at relatively high beam current, and the three-color images appear to slip.

It is known to design the aperture shape of the electrode of an electron gun to be an ellipse to reduce the deflection defocus. But this expedient for improving the structure of the electron gun electrode adversely changes the focusing property of the electron gun and also the picture resolution property of the color picture tube. Futhermore, it is difficult to construct a gun assembly using an electrode with an ellipse shaped aperture as compared to using a circular shaped aperture electrode. Therefore, improvement is not easily achieved and satisfactory results are not necessarily obtained.

SUMMARY OF THE INVENTION

Accordingly, an object of the invention is to provide an inline plural beam color picture tube which eliminates or substantially reduces the aforementioned deflection defocus caused by the non-uniformity of the deflection fields.

A futher object of the invention is to provide an easily operable color picture tube having good convergence characteristics as well as good picture resolution.

A further object of the invention is to provide an in-line plural beam color picture tube having properties which have been developed to a quite high degree.

The foregoing and other objects are attained in accordance with one aspect of the present invention through the provision of deflection defocus correcting elements for at least axially separated beams passing through a position which is not on the tube axis. These elements are disposed adjacent the electron beam emitting outlets of the electron gun so that the paths of the side electron beams are disposed between the elements and in such a manner as to cooperate with the magnetic fields of the deflection yoke or of the convergence yoke. By means of this structure, it is possible to make the deflection defocus of the side beams correct and approximate to that of the center beam passing along the tube axis. More particularly, when such elements are provided for all the electron beams, it is possible to reduce the total amount of the deflection defocus and to make the distortions of the electron beams similar to one another. This provides an excellent color picture tube in which the properties are developed to a quite high degree.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENTS

Figure 3:
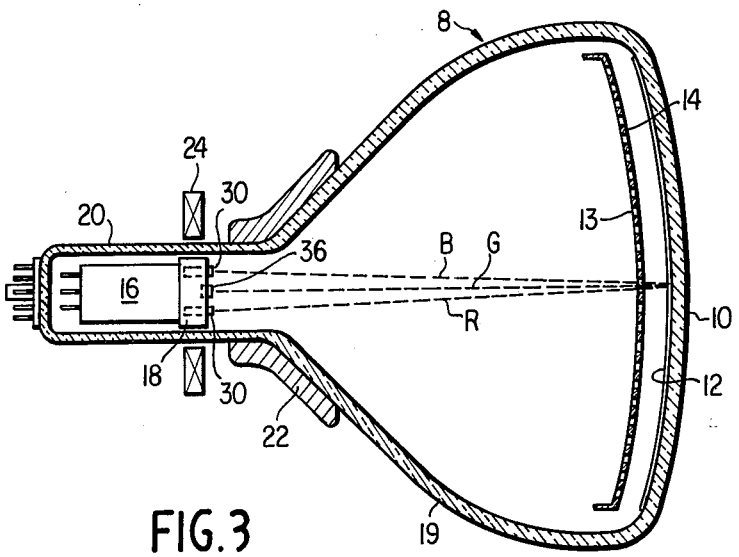
FIG. 3 is a top view in longitudinal cross-section of a color cathode ray tube according to the invention.

Referring now to the drawings, wherein like reference numerals designate identical or corresponding parts throughout the several views, and more particularly to FIG. 3 thereof, FIG. 3 illustrates a color cathode ray tube 8 comprising an evacuated envelope including a face plate 10, a neck section 20, and an interconnecting funnel section 19. A phosphor screen 12 formed on the inner surface of the face plate 10 includes a plurality of red, green and blue phosphor elements in the form of dots or in the form of stripes or the like. Also, on its surface, an electrically conductive layer of, e.g., aluminum is disposed, and constitutes what is usually known as a metal backing screen. Disposed within the tube adjacent the phosphor elements is a shadow mask 14 including a plurality of apertures 13. The apertures 13 are so arranged with relation to the phosphor elements that they serve to screen the electron beams such that portions of the electron beams passed by the apertures 13 impinge only on their respective color phosphor elements. Disposed within the neck 20 is an electron gun assembly 16 comprising, for example, three electron guns positioned side by side in an in-line arrangement for emitting three electron beams B, G, and R. A convergence cup 18 is mounted on the beam outlet portion of the electron gun. The three electron beams B, G, and R are arranged in an in-line passing along a horizontal plane; the central beam G passes along the tube axis, and the pair of side beams B and R pass through positions which are not on the tube axis. In the present invention, these side beams are referred to as axialy separated beams.

Disposed around the outside of the glass envelope along a funnel section 19 thereof is a deflection yoke 22 adapted to be energized by suitable souces of scanning currents (not shown) for producing a magnetic field which will deflect the electron beams to form a scanned raster on the screen.

Disposed behind the deflection yoke 22 on the neck portion 20 of the glass envelope is a convergence assembly 24. The convergence assembly 24 is disposed to surround the convergence cup 18 in which the magnetic shields are arranged between the center beam G and the side beams B and R for shielding each beam from the convergence fields of the other beams. However, if desired, the magnetic shields can be eliminated. The convergence assembly 24 comprises, for example, an E-shaped core having leg parts and end wall gaps on which permanent magnets are rotatably mounted for providing adjustable static fluxes which cooperate with the dynamic convergence flux. However, the convergence assembly for use with an in-line type color cathode ray tube is not limited to the structure described above.

Disposed on the beam paths and adjacent the convergence cup 18 are deflection defocus correcting elements 30 and raster control elements 36. A more detailed description of these elements will be given hereinafter with reference to FIG. 5.

Figure 4:
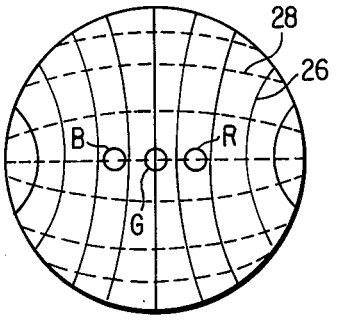
FIG. 4 is an illustration of the net magnetic deflection field produced by the deflection yoke illustrated in FIG. 3.

FIG. 4 is an illustration of the predominant magnetic deflection field produces by the deflection yoke illustrated in FIG. 3. As shown in FIG. 4, the horizontal and vertical field nonuniformity will vary from point to point along the longitudinal axis of the tube. A deflection field for deflecting the beams in a horizontal direction is illustrated by the solid lines flux 26 which extend in a vertical direction. As shown in the figure, this magnetic field is pin-cushioned shaped, the lines of flux being convex when viewed from the center of the figure. It should be noted that this horizontal deflectin field produces negative horizontal isotropic astigmatism of the electron beams.

Also shown in FIG. 4 are lines of flux 28 which represent a magnetic deflection field for deflecting the beams in a vertical direction. The vertical deflection field is generally barrel-shaped. These particular deflection fields are known for an in-line beam color picture tube.

It is also known that the convergence problems associated with such an in-line beam color picture tube can be simplified through the use of raster control elements disposed in the deflection field. Thus, in U.S. Pat. No.

3,860,850 to S. Takenaka et al, issued Jan. 14, 1975 and assigned to the assignee of the present invention, there is disclosed raster control means including two pair of control members. The details of the raster control elements will be explained with reference to FIG. 5.

Figure 5:
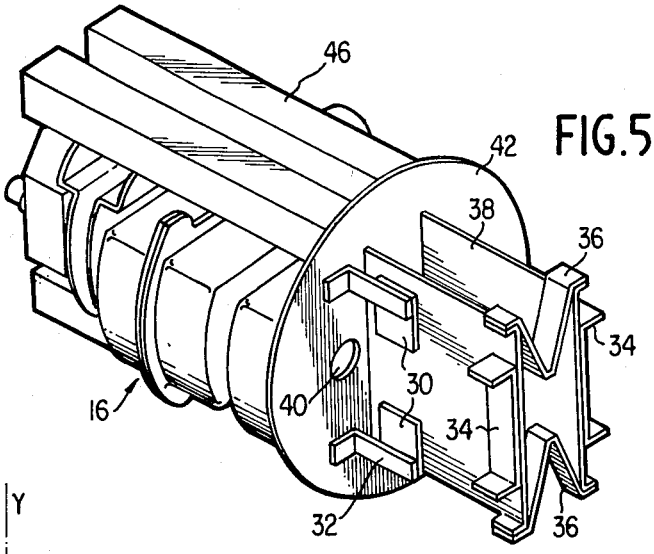
FIG. 5 is a perspective view illustrating the raster control elements and the deflection defocus correcting elements suitable for use in the picture tube of FIG. 3.

As shown in FIG. 5, the raster control means comprises two pair of control members 34 and 36 at the top of the electron gun 16. The first control members 34 are formed of suitable shaped, for example, U-shaped or circular shaped, elements made of material of high magnetic permeability and are so disposed as to surround the side beams B and R in FIG. 3. The second control members 36 are also made of high magnetic permeability and are mounted above and below the center beam G.

These control members are coupled with the leakage flux of the deflection yoke 22 and render the deflection sensitivity of the center beam G different from that of the side beams B and R. The first control members 34 shield the side beams B and R from both horizontal and vertical deflection fields to reduce both horizontal and vertical deflection flux acting on the side beams as compared with that acting on the center beam G.

The second control members 36 enhance the horizontal deflection flux acting on the center beam G as compared with that acting on the side beams B and R and modify the flux distribution in the region of the center beam so as to reduce the vertical deflection flux acting on the center beam as compared with that acting on the side beams.

These control members enable the side beam rasters formed on the screen to be equally displaced from the center beam raster. Such equal displacement of the side beams simplifies the convergence circuit.

In accordance with the present invention, the deflection defocus correcting elements 30 are disposed to cooperate with the magnetic deflection field or with the magnetic convergence field. Referring to FIG. 5 which shows a particular embodiment of the invention, the deflection defocus correcting elements 30 are disposed adjacent the beam outlet apertures 40 of the end wall 42 of the convergence cup and behind the raster control elements 34. According to this embodiment, these elements are mounted on the magnetic shield 38 by support members 32 so as to be disposed between the paths of the side beams B and R respectively. These deflection correcting elements 30 are formed of a suitable shape such as, for instance, a rectangular thin plate and are comprised of high magnetic permeability. Their form and arrangement will be discussed in conjunction with FIGS. 6 and 7.

Figure 6:
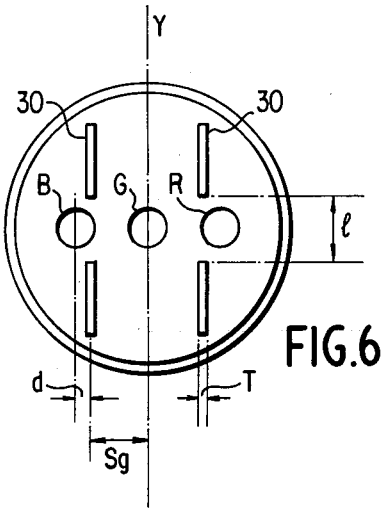
FIG. 6 illustrates the deflection defocus correcting elements of the present invention.

FIG. 6 illustrates a front view of the deflection defocus elements when viewed from the screen side. As shown in FIG. 6, they are disposed in correspondence with the side beams B and R and are biassed from the center of the side beams B and R toward the center beam G respectively. The thickness T of the deflection defocus elements 30 is made narrow so that a magnetic flux of high density will pass between the top element and the bottom one.

Figure 7:
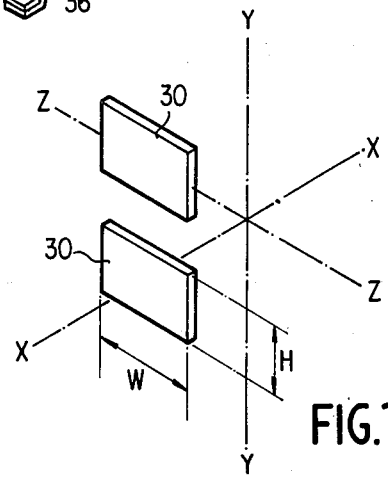
FIG. 7 is a perspective view of the deflection defocus correcting elements illustrated in FIG. 5.

It is advantageous to make this thickness smaller than the diameter of the side beam having the distortion to be corrected. Accordingly, in their simplest form, they are preferably formed as thin rectangular plates. As shown in FIG. 7 each plate 30 has a width W along the tube axis Z—Z and a height H along the vertical axis Y—Y.

In a practical embodiment for using a width deflection angle color picture tube in which the axial separation distance $Sg$ of the side beam is 8.4 mm, these correcting elements can be formed as a rectangular plate with a width W of 10.00 mm, a height H of 7.0 mm and a thickness T of 0.25. The distance $l$ between the top element and the bottom one may be 3.5 mm and the bias $d$ from the center of the side beam may be 0.5 mm.

The form, dimensions and arrangement of these correcting elements are determined in consideration of the deflection defocus properties caused by the magnetic fields of the deflection yoke and of the convergence yoke. They are not easily determined theoretically. In practice, they are determined by trail and error taking into consideration the overall properties of the color picture tube. With respect to this, some of the important points to be considered are as follows:

It must be considered whether the deflection defocus correcting elements are coupled to the convergence magnetic field or whether they are coupled to the deflection magnetic fields. Making the thickness T of the correcting element less than the diameter of the electron beam outlet aperture is not an essential condition, but it is an important factor in rendering effective the action of the deflection defocus correcting elements. Accordingly, this form is preferable to enhance the magnetic flux on the electron beams.

Figure 8:
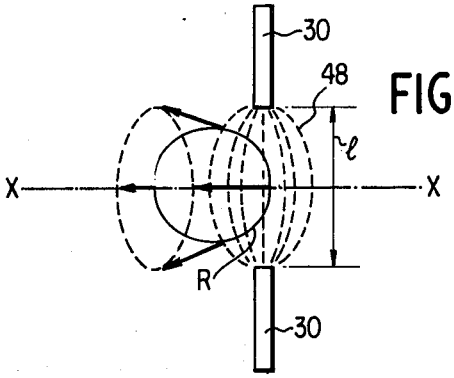
FIG. 8 is a diagram illustrating the action of the deflection defocus correcting elements.
Figure 9:
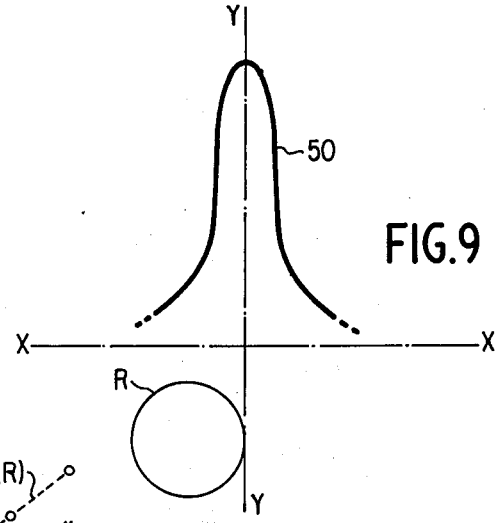
FIG. 9 is a diagram showing the magnetic flux density in the vicinty of the deflection defocus correcting elements.

The bias of the correcting elements from the center of the electron beams is also of considerable importance for rendering the action effective. FIGS. 8 and 9 illustrate the action of the deflection defocus correcting elements when they are arranged as described above.

Figure 1:
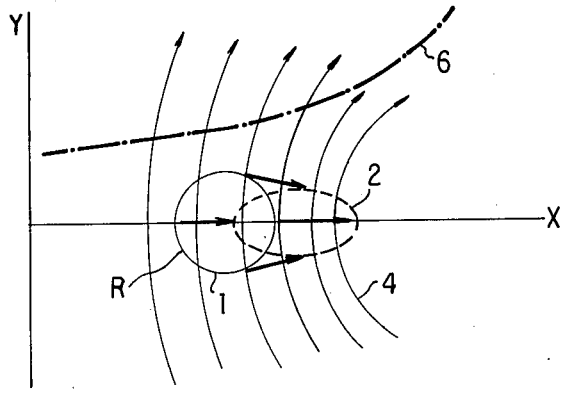
FIG.1 PRIOR ART
FIG. 1 is a diagram illustrating the beam distortion which an electron beam receives from a non-uniform pin-cushion type horizontal deflection magnetic field.
Figure 2:
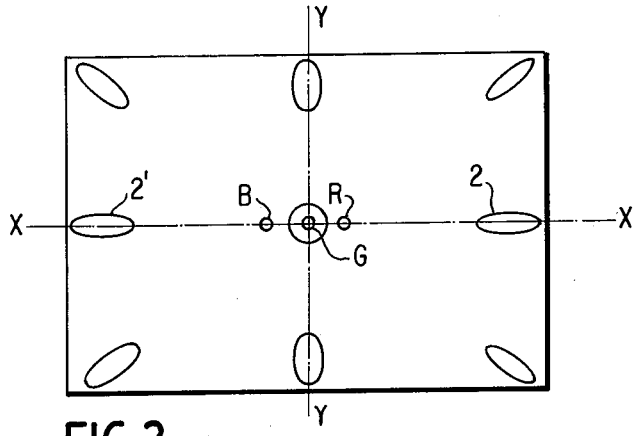
FIG.2 PRIOR ART
FIG. 2 is diagram showing the state of the beam distortion appearing on the screen.

As shown in FIG. 8, because of the influence of the magnetic fields 48 which are produced between the correcting elements 30, the electron beam R is subjected to non-uniform forces as shown by the arrows in the drawing. The curve 50 of FIG. 9 shows the magnetic flux density distrubution in the vicinity of the deflection defocus correcting elements. Accordingly, the side beams are distorted approximately into the form of ellipses having a length in the vertical direction as shown in broken lines. On the other hand, while passing the deflection field, the distorted electron beams are subjected to forces tending to compress the shape so as to produce the elliptical shape having a longitudinal axis in the horizontal direction as shown in FIG. 1. Consequently, when the beams are passing through the convergence fields and the deflection fields, the distortion of the beams caused by the magnetic fields of the deflection defocus correcting elements neutralize one another with the result that the shape of the electron beams on reaching the phosphor screen returns approximately to the circular shape.

Although the biased arrangement of the deflection defocus correcting elements from the centers of the side beams has been considered, it is not essential. In particular, when the deflection defocus correcting elements are coupled to the dynamic convergence fields which vary in time, the bias may be made equal to zero. This is to say that the correcting elements may be disposed on the center of each beam by taking into consideration the reduction of the beam distortion as shown in FIGS. 12–16.

As will be understood from the above, the deflection defocus correcting elements of the present invention import asymmetrical or symmetrical forces to the electron beams to correct the beam distortion caused by the deflecting fields. Accordingly, it is clearly different from the positional correction carried out by the pole pieces of the convergence apparatus in prior art tubes.

Some of the important advantages of the deflection defocus correcting elements of the present invention are as follows.

Figure 10:
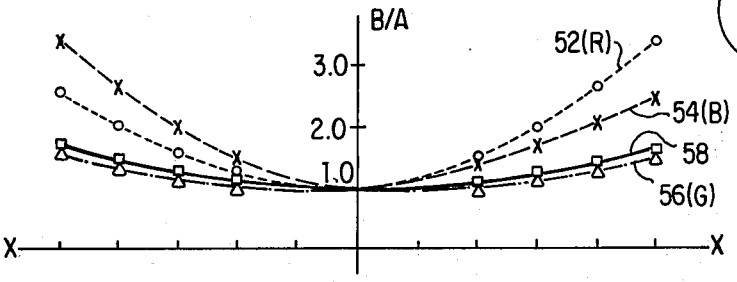
FIG. 10 is a diagram showing the deflection defocus of three in-line electron beams and compares the case where the deflection defocus correcting elements are provided with the case where they are not provided.

FIG. 10 shows the variation of magnitude of the deflection defocus on the horizontal axis X—X of the phosphor screen. The magnitude of the deflection defocus is shown by the ratio B/A in which the diameter of the beam spot on the screen in the vertical direction is taken as A and its diameter in the horizontal direction is taken as B. The curves 52 and 54 in FIG. 10 show the deflection defocus of the side beams R and B, respectively, in a case in which the deflection defocus correction elements are not provided. The curve 56 is the deflection defocus curve of the center beam G in the same case. The curve 58 shown by a full line is the deflection defocus of the side beams R and B in the case in which the deflection defocus correcting elements are provided.

When the value B/A is 1, the beam spot is a perfect circle. FIG. 10 shows that the deflection defocus of the side beams of the three electron beams in the in-line arrangement is considerably greater than that of the center beam and is asymmetrical on the left and right of the screen.

On the other hand, when the deflection defocus correcting elements of the present invention are disposed for such beams, the deflection distortion can be reduced to less than half as can be seen by comparing the curves 52 and 54 with the curve 58. Furthermore, it can be made approximately the same as that of the center beam G. This shows that the deterioration of the picture resolution due to the deflection defocus is smaller than that experienced with a conventional tube in which defocus correcting elements are not provided.

Furthermore, this shows that there is no slippage of the threerasters due to deflection defocus and that a completely coincident color picture can be reproduced.

Figure 11:
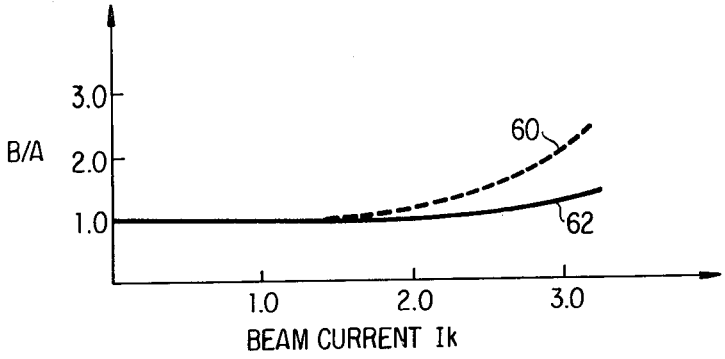
FIG. 11 is a diagram showing the relationship between the beam current and the deflection defocus and compares the cases in which the deflection defocus correcting elements are respectively present and absent.

FIG. 11 shows another important advantage of the invention. As shown by curve 60, the value of the deflection defocus B/A in the conventional tube changes significantly as the beam current $I_K$ increases. However, when the above mentioned deflection defocus correcting elements are provided, the change is small and is less than 40% of that previously experienced. Because of this effect, it is apparent that the action of the deflection defocus correcting elements becomes greater as the current increases causing the beam diameter to become greater.

Since the deflection defocus does not become very great even when the beam current increases, the disadvantages of conventional tubes such as misconvergence at high beam current are avoided. This misconvergence with conventional tubes appears when the beam current increases even though convergence occurs when the beam current is low, as aforementioned. Therefore, the quality of a bright picture, which tended to deteriorate, is greatly improved by providing the deflection defocus correcting elements. Thus, the advantages of the invention are particularly significant.

Further embodiments of the present invention will be described hereinafter.

Figure 12:
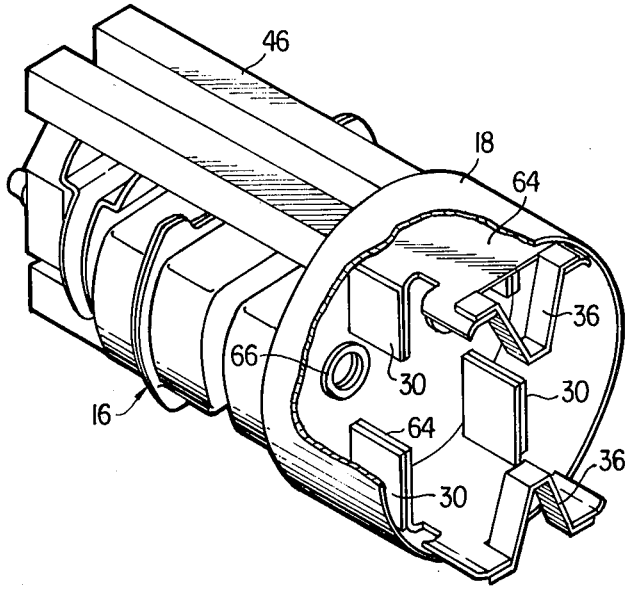
FIG. 12 is a perspective view of another embodiment according to the invention.

FIGS. 12–16 show embodiments in which the deflection defocus correcting elements are disposed at the center of the beam outlet apertures. FIG. 12 shows an embodiment in which the conventional magnetic shields are eliminated from the convergence cup 18 and a pair of circular shaped raster control members 66 are directly mounted on the end wall of the convergence cup 18 to surround the side beams emitted from the electron gun 16 which is constructed by the support members 46. As shown in the figure, the deflection defocus correcting elements 30 and the V-shaped raster control members are mounted on the same holding members 64 which are arranged in the convergence cup 18. As explained with reference to FIG. 5, the circular shaped elements 66 having high magnetic permeability are coupled with the leakage flux of the deflection fields and render the deflection sensitivity of the side beams different from that of the center beam. The function of the deflection defocus correcting elements 30 and of the V-shaped elements 36 are substantially the same as that explained with reference to FIG. 5. In FIGS. 5 and 12, the electron gun 16 is illustrated for simplification as a unitized gun but this is not essential for the invention.

Thus, the abovementioned raster control means are important in the present invention for rendering effective the action of the deflection defocus correcting elements.

Figure 13:
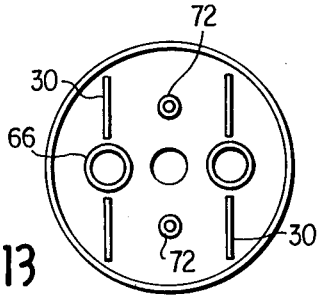
FIGS. 13, 14, 15 and 16 are front views showing the essential parts of other embodiments of the present invention.
Figure 14:
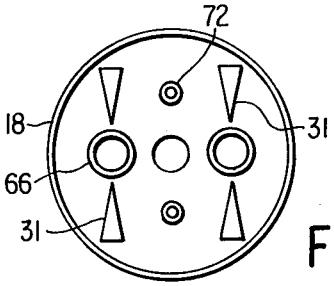

FIGS. 13 and 14 illustrate embodiments in which the raster control members 66 and 72 are circular-shaped. In FIG. 14, the cross-sectional shape of the deflection defocus correcting elements 31 is triangular so as to concentrate the magnetic flux between them.

Figure 15:
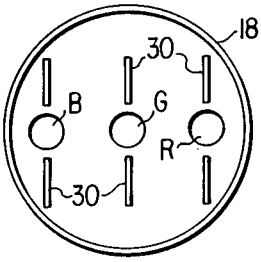
Figure 16:
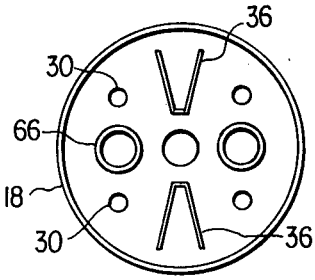

FIG. 15 shows the deflection defocus correcting elements 30 arranged for each of the three electron beams B, R and G in an in-line arrangement. The shapes and dimensions of the correcting elements for the center beam G do not necessarily have to be the same as those of the elements for the side beams B and R. Moreover, the distance between the top and bottom elements for the center beam do not necessarily have to be the same as the distance between the elements for the side beams. When deflection defocus correcting elements are disposed for each of the three electron beams in this manner, it is possible to correct the deflection defocus of the center beam, and in association with the correction of the center beam, it is possible to make the deflection defocus of each of the three electron beams small and identical with one another by adjustment of the shapes and dimensions of the deflection defocus correcting elements. Accordingly, an even further improved excellent color picture tube can be provided.

The foregoing description relates to in-line type color picture tubes emitting three electron beams passing along a horizontal plane. However, the plane does not necessarily have to be a horizontal plane because the invention can be applied in cases where the plural beams pass along some other plane.

Also, the description of the foregoing embodiments is mainly directed to cases in which the deflection defocus correcting elements are so disposed as to be coupled to the convergence fields. However, these correcting elements of the present invention can also be so arranged to be coupled to the deflection fields and, of course, the same advantages will be obtained.

The invention has been described in terms of specific examples and embodiments. However, obviously, numerous modifications and variations of the present invention are possible in light of the above teachings. For example, it is possible to eliminate the raster control elements 66 in the embodiments shown in FIGS. 12, 13, 14 and 16 because the deflection correcting elements 30 perform a similar function. It is therefore to be understood that within the scope of the appended claims the invention may be practiced otherwise than as specifically described herein.

WHAT IS CLAIMED AS NEW AND DESIRED TO BE SECURED BY LETTERS PATENT OF THE UNITED STATES IS:

1. A color cathode ray tube comprising:
an evacuated envelope including a face plate, a neck portion and an interconnecting funnel section;
a phosphor screen formed on the inner surface of the face plate;
a shadow mask including a plurality of apertures disposed adjacent to the phosphor screen;
electron gun means for projecting a central electron beam and a pair of side beams in an in-line arrangement directed toward the screen through horizontal and vertical deflection fields produced by a deflection yoke; and
deflection defocus correcting means comprising a pair of similarly shaped elements having high magnetic permeability and symmetrically located above and below the plane of the beam arrangement and disposed adjacent to the side beams and biassed substantially inwardly from the center of the beam bundle of said side beams so as to couple the deflection fields and to introduce asymmetrical forces to said side beams for correcting the beam distortion caused by the non-uniformity of said deflection fields.

2. A color cathode ray tube as in claim 1 wherein the electron gun means has an outlet end for projecting the electron beams, the deflection defocus correcting elements being disposed adjacent to the electron beam outlet of the electron gun means and between the path of the beams.

3. A color cathode ray tube as in claim 1 wherein the deflection defocus correcting elements comprise a thin plate having a width along the path of the electron beam and a height in the plane perpendicular to the plane of the beam arrangement.

4. A color cathode ray tube as in claim 1 wherein the deflection defocus correcting elements are disposed equidistant from the center beam.

5. A color cathode ray tube comprising:
a phosphor screen;
a shadow mask having a multiplicity of apertures disposed adjacent to the phosphor screen;
electron gun means for projecting a plurality of electron beams in an in-line arrangement toward the screen through deflection fields produced by a deflection yoke;
raster control means comprising at least a pair of control members disposed adjacent the path of the electron beams and in the region of the deflection field between the electron gun means and the deflection yoke;
deflection defocus correcting means comprising a pair of elements of high magnetic permeability symmetrically located above and below the plane of the beam arrangement and disposed adjacent the path of the side beams in an in-line arrangement to impart assymetrical forces to said side beams to neutralize the beam distortion caused by the non-uniformity of the deflection fields.

6. A color cathode ray tube as in claim 5 wherein the raster control means comprises a first control member comprising a pair of similarly shaped elements disposed about respective side beams and a second control member comprising a pair of similarly shaped elements symmetrically located equidistantly above and below the path of the center beam, the deflection defocus correcting elements being disposed adjacent the first control member of the raster control means.

7. A color cathode ray tube as in claim 6 wherein the second control member of the raster control means comprises a pair of generally V-shaped elements having apices which face each other and the deflection defocus correcting means for the side beams comprises two pair of thin plates disposed between respective side beams.

8. A color cathode ray tube as in claim 6 wherein the second control member of the raster control means and the deflection defocus correcting elements are mounted on the same support members symmetrically located above and below the plane of the beam arrangement.

9. A color cathode ray tube as in claim 6 wherein the first control member of the raster control means is generally circular shaped and the deflection defocus correcting elements are aligned with the circular shaped control member.

10. A color cathode ray tube as in claim 6 wherein the second control member of the raster control means is generally V-shaped and the deflection defocus correcting elements are disposed behind the V-shaped second control member.

11. A color cathode ray tube comprising:
an evacuated envelope including a face plate, a neck portion and an interconnecting funnel section;
a phosphor screen formed on the inner surface of the face plate;
a shadow mask including a plurality of apertures disposed adjacent to the phosphor screen;
electron gun means for projecting a central electron beam and a pair of side beams in an in-line arrangement directed toward the screen through a pin-cushion shaped horizontal deflection field produced by a deflection yoke; and
high magnetic permeability deflection defocus correcting means disposed adjacent the paths of the side beams to impart asymmetrical forces to the side beams to compensate for the beam distortion caused by the non-uniformity of the pin-cushion shaped deflection field.

12. A color cathode ray tube as in claim 1 wherein the deflection defocus correcting means comprises two pair of generally triangular shaped elements.

13. A color cathode ray tube as in claim 1 wherein the defocus correcting means comprises two pair of generally circular shaped elements.

* * * * *